United States Patent [19]

Nieuwendijk et al.

[11] Patent Number: 4,566,120

[45] Date of Patent: Jan. 21, 1986

[54] LOUDSPEAKER SYSTEM AND LOUDSPEAKER FOR USE IN A LOUD-SPEAKER SYSTEM FOR CONVERTING AN N-BIT DIGITIZED ELECTRIC SIGNAL INTO AN ACOUSTIC SIGNAL

[75] Inventors: Joris A. M. Nieuwendijk; Franciscus J. Op de Beek; Georgius B. J. Sanders; Wilhelmus D. A. M. Van Gijsel; Jacob M. Van Nieuwland, all of Eindhoven, Netherlands

[73] Assignee: U.S. Philips Corporation, New York, N.Y.

[21] Appl. No.: 648,427

[22] Filed: Sep. 7, 1984

[30] Foreign Application Priority Data

Sep. 15, 1983 [NL] Netherlands ..... 8303186

[51] Int. Cl.[4] ..... H04R 9/06

[52] U.S. Cl. ..... 381/117; 179/115.5 VC

[58] Field of Search ..... 381/117, 96, 111, 120, 381/121; 179/115.5 PV, 115.5 VC, 115.5 R, 115 R; 329/193; 370/110.3; 455/614

[56] References Cited

U.S. PATENT DOCUMENTS 4,121,205 10/1978 Iga et al. ..... 340/347 DA

FOREIGN PATENT DOCUMENTS 57-186898 11/1982 Japan ..... 381/117

58-31699 2/1983 Japan ..... 179/115.5 VC

*Primary Examiner*—Gene Z. Rubinson

*Assistant Examiner*—Danita R. Byrd

*Attorney, Agent, or Firm*—Thomas A. Briody; William J. Streeter; Marianne Rich

[57] ABSTRACT

A loudspeaker system for converting an n-bit digitized electric signal (11) into an acoustic signal comprises an electrodynamic loudspeaker (1) with n voice-coil sections (4.1, 4.2, . . . 4.n) which cooperate with a magnet system (3). The loudspeaker system further comprises means (18.1, 18.2, . . . 18.n) for short-circuiting a voice-coil section if the value of the bit corresponding to the voice-coil section is such that the relevant voice-coil section is not driven.

6 Claims, 3 Drawing Figures

LOUDSPEAKER SYSTEM AND LOUDSPEAKER FOR USE IN A LOUD-SPEAKER SYSTEM FOR CONVERTING AN N-BIT DIGITIZED ELECTRIC SIGNAL INTO AN ACOUSTIC SIGNAL

The invention relates to a loudspeaker system for converting an n-bit digitized electric signal (n being an integer and $\geqq 2$) into an acoustic signal, which system includes an electrodynamic loudspeaker comprising a diaphragm, a magnet system, and a voice-coil device which cooperates with the magnet system and which comprises n voice-coil sections, means being provided for driving each of the n voice coil sections when a respective one of the n bits of the digitized electric signal has a given value. The invention also relates to an electrodynamic loudspeaker for use in a loudspeaker system in accordance with the invention. A loudspeaker system of the type defined in the opening sentence is known from the publication "The acoustic characteristics of Moving-Coil Type PCM digital loudspeakers (I)", by K. Inanaga and M. Nishimura, from the Proceedings of the Spring Conference of the Acoustical Society of Japan, pages 649, 650, May 1981.

The known loudspeaker system comprises an electrodynamic loudspeaker in the form of a moving coil loudspeaker, the voice-coil devices being arranged on a voice-coil former as separate voice coils.

However, the invention is not limited to loudspeaker systems comprising an electrodynamic loudspeaker in the form of a moving-coil loudspeaker. The invention is equally applicable to loudspeaker systems using different types of electrodynamic loudspeakers, for example loudspeakers of the ribbon type in which the voice-coil sections are arranged on the diaphragm in the form of a plurality of conductors. The transducer described in the afore-mentioned publication comprises a plurality of voice-coil sections each having 48 turns. The means for driving the voice-coil sections are constructed so that the voice-coil sections are driven by switched voltages whose magnitudes vary (increase) in conformity with the significance of the bits corresponding to the voice-coil sections. This means that the known loudspeaker system requires as many supply voltages for driving the voice-coil sections as there are voice-coil sections, or a number of series resistors corresponding to the number of voice-coil sections. The known loudspeaker system has the disadvantage that it produces a substantial amount of distortion, in particular in the lower part of the frequency range. It is the object of the invention to provide a loudspeaker system with a substantially lower distortion. According to the invention the loudspeaker system is characterized in that the loudspeaker system is provided with means for short-circuiting a voice-coil section if the value of the corresponding bit is such that the relevant voice-coil section is not driven.

The invention is based on the recognition of the fact that unless steps are taken to counteract the effect, during operation of a digital loudspeaker the electrical quality factor is not constant but varies and depends on the level (amplitude) of the signal with which the loudspeaker is driven.

For conventional moving-coil loudspeakers for the reproduction of an analogue electric signal the electrical quality factor $Q_e$ satisfies the following equation:

$$Q_e = \frac{m\,\omega_o R_e}{(B1)^2}$$

see "Designing hi-fi speaker systems" by D. Hermans and M. D. Hull, an Elcoma publication by N. V. Philips' Gloeilampenfabrieken of February 1980, formula (2.24) on page 17 and formula (3.43) on page 32, where m = the mass of the diaphragm, voice coil, voice-coil former and the air load (kg).

$W_o = 2\pi\ f_o$ where $f_o$ is the resonant frequency of the vibrating system comprising the diaphragm, voice coil and voice-coil former.

$R_e$ = the electrical resistance of the voice coil ($\Omega$).

B = the magnetic induction in the air gap ($Wb/m^2$)

1 = the length of the turns of the voice coil as far as they extend in the air gap (m).

In a digital loudspeaker one or more voice-coil sections will not be driven depending on the amplitude of the drive signal, which means that the value of $R_e$, and consequently the value of the electrical quality factor $Q_e$, is no longer constant but varies in dependeance up the amplitude of the loudspeaker drive signal. By short-circuiting those voice-coil sections which are not driven it can be achieved that the electrical quality factor $Q_e$ remains constant, assuming that the impedance of the power-supply source is zero ohms. As the mechanical quality factor $Q_m$ is generally larger than the electrical quality factor $Q_e$ and, moreover, the electrical quality factor is generally selected to be substantially equal to 1, it follows, using the formula $$\frac{1}{Q_t} = \frac{1}{Q_e} + \frac{1}{Q_m}$$

for the overall quality factor $Q_t$ of the loudspeaker, that if this is the case $Q_t \approx 1$, is constant and is substantially independent of the amplitude of the drive signal.

Since the electrical quality factor $Q_e$ can be practically constant the transfer characteristic of the loudspeaker, which is closely related to $Q_e$, can also be constant and independent of the amplitude of the drive. As a result of this, the distortion in the output signal of the loudspeaker, which in other cases mainly manifests itself in variations of the low-frequency portion of the transfer characteristic (in the region around the resonant frequency of the loudspeaker) due to variations of $Q_e$, can now be largely eliminated.

A loudspeaker system in accordance with the invention may be characterized further in that the means for short-circuiting a voice-coil section comprise a switch corresponding to and arranged in parallel with each voice-coil section and means for controlling the switches in such a manner that a switch is closed if the associated voice-coil section is not driven and is open if the associated voice-coil section is driven. In this manner the desired short-circuiting of a non-energized voice-coil section can be obtained very simply. Such a system may be characterized further in that said means for short-circuiting a voice-coil section comprise an inverting element corresponding to each switch and whose output is coupled to the corresponding switch, an input of the inverting element being coupled to an input of the means for driving the voice-coil section. If for example one of the signal bits is logic "zero", in other words if the relevant voice-coil section is not driven, a logic "one" signal can be applied to the corresponding switch via the associated inverting element, so that this switch is closed and the voice-coil section is consequently short-circuited. However, if the bit is logic "one" a logic "zero" signal can be applied to the corresponding switch via the associated inverting element, so that this switch is open. The voice-coil section is then driven.

Each switch may comprise, for example, a transistor whose collector and emitter are arranged in parallel with the associated voice-coil section. Alternatively, other types of switching devices, such as thyristors, may be used.

Each switch may comprise a first transistor of one conductivity type and a second transistor of the other conductivity type, both transistors being arranged in parallel with the associated voice-coil section, the emitters of both transistors being coupled to one end of the voice-coil section and the collectors of both transistors being coupled to the other end of the associated voice-coil section, the output of the inverting element being coupled to the base of one transistor and, via an amplifier stage with a negative gain factor, which is preferably equal to $-1$, to the base of the other transistor. Further, it is to be noted that the steps in accordance with the invention as described in the foregoing for a digital loudspeaker system, the use of means for short-circuiting a voice-coil section, may also be applied to a single separate digital loudspeaker. In that case the electrodynamic loudspeaker itself is provided with said means for short-circuiting a voice-coil section.

The invention will now be described in more detail, by way of example, with reference to the drawing in which identical reference numerals in different FIGS. refer to identical elements. In the drawing.

Although the step of short-circuiting a voice-coil section is applicable to any digital loudspeaker system comprising an electrodynamic loudspeaker, the step will be discussed with reference to FIG. 1 for a loudspeaker system in accordance with another invention which is described in the Applicant's European Application which claims priority from Netherlands patent application No. 83.03.184, and which is filed simultaneously with the present Application.

Figure 1:
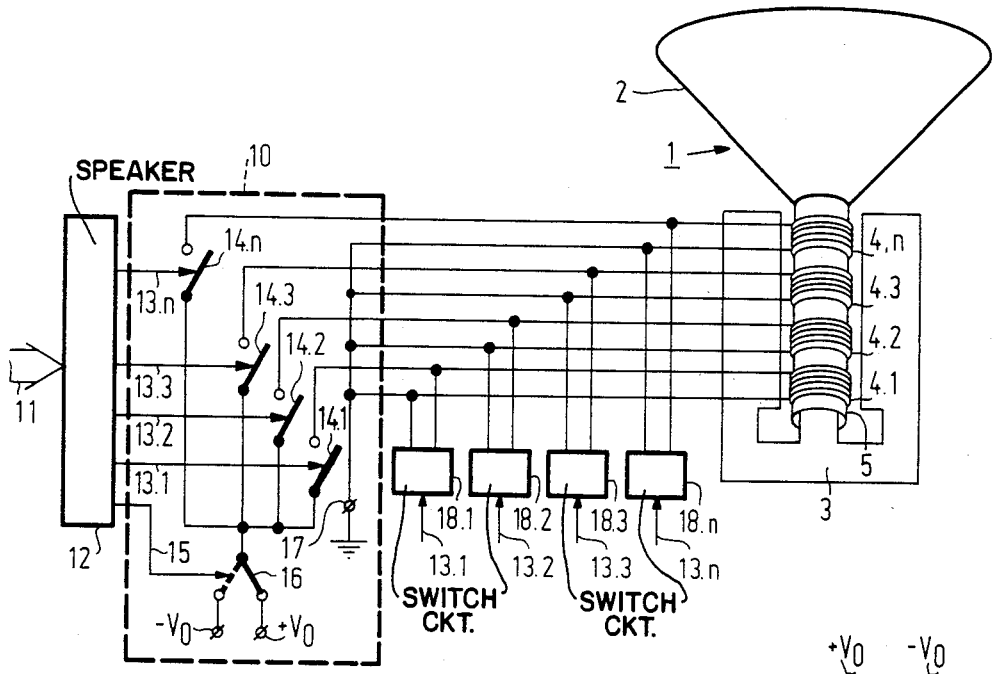
FIG. 1 shows a loudspeaker system in accordance with the invention.

FIG. 1 shows schematically, a digital loudspeaker system which includes an electrodynamic loudspeaker 1 comprising a diaphragm 2, a magnet system 3, and n voice-coil sections 4.1, 4.2, 4.3, . . . **4.*n* which cooperate with the magnet system 3, n being an integer and $\geqq 2$. The voice-coil sections each comprise a conductor, the length of the conductors of all voice-coil sections being equal. The voice-coil section are all arranged on a voice-coil former 5. This voice-coil former 5 is secured to the diaphragm 2. Means for driving the voice-coil sections bear the reference numeral 10. The digitized electric signal 11, if necessary after conversion in a converter 12, comprises n bits for driving the n voice-coil sections and one sign bit. Via the lines 13.1, 13.2, 13.3, . . . 13.*n* the n bits are applied to and control associated switches 14.1, 14.2, 14.3, . . . 14.*n*. Via the line 15 the sign bit is applied to and controls a switch 16. Depending on the sign bit the switch 16 switches between the positive and negative supply voltages $V_o$ and $-V_o$. Via the switches 14.1 to 14.*n* one of the ends of each of the windings of the voice-coil sections 4.1 to 4.*n* is connected or not connected to the positive or the negative supply voltage. The other ends of the windings of the voice-coil sections 4.1 to 4.*n* are connected to a point 17 of a constant potential (earth). The most significant bit of the digitized electric signal is applied to the switch 14.1 via the line 13.1 and thus controls the drive of the voice-coil section 4.1. Consecutive less significant bits are applied to the switches 14.2, 14.3, . . . via the lines 13.2, 13.3, . . . (in this order) and thus control the drives of the voice-coil sections 4.2, 4.3, . . . . The least significant bit is applied to switch 14.*n* via the line 13.*n* and drives the voice-coil section 4.*n***.

The means 10 for driving the voice-coil sections operate in such a manner that if a high value (logic "one") is applied to the switch 14.1, via the line 13.1, this switch is closed. Conversely, if a low value ("logic "zero") is applied to the switch 14.1 via the line 13.1, this switch is open. Obviously, the same applies to the control of the other switches 14.2 to 14.*n*.

If $A_m$ is the area of a perpendicular cross-section of the conductor of the voice-coil section **4.*m*, m ranging from 1 to n, the following equation is valid for the ratio between $A_m$ and $A_1$, which is the area of a perpendicular cross-section of the conductor of the voice-coil section 4.1** corresponding to the most significant bit:

$$A_m : A_1 = 1 : 2^{m-1}$$

This means that, starting from the voice-coil section 4.1 corresponding to the most significant bit, the areas of the perpendicular cross-sections of the conductors of the voice-coil sections 4.2, 4.3, . . . corresponding to consecutive less significant bits 13.2, 13.3, . . . each time decrease by a factor of 2.

The resistance values for the conductors of the voice-coil sections corresponding to consecutive less significant bits increase, which means that the currents through the conductors corresponding to consecutive less significant bits each time decrease by a factor of 2, ensuring a correct drive of the voice-coil sections in conformity with the significance of the bits. So far the description relates to a novel loudspeaker system as described in the afore-said simultaneously filed Patent Application.

Figure 2:
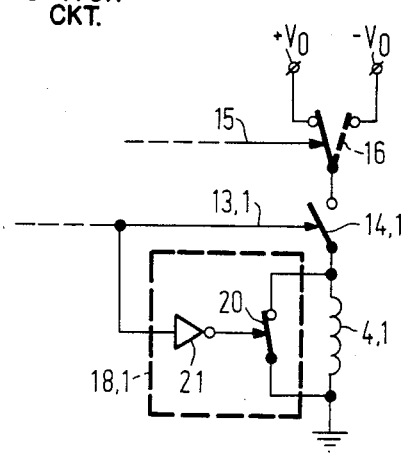
FIGS. 2 and 3 show the means for driving a voice-coil section and the means for short-circuiting a voice-coil section in more detail.

The step in accordance with the invention, i.e. the provision of means for short-circuiting a voice-coil section if the value of the corresponding bit is such that the relevant voice-coil section is not driven is illustrated schematically in FIG. 1 by the blocks 18.1, 18.2, 18.3, . . . **18.*n*. The corresponding bits are applied as input signals to the blocks 18.1 to 18.*n* via the lines 13.1 to 13.*n*. The means 18.1 to 18.*n* for short-circuiting the voice-coil sections operate in dependence upon the signals applied via the lines 13.1 to 13.*n* in such a manner that a voice-coil section is short-circuited if the value of the corresponding bit is such that the relevant voice-coil section is not driven. This will be described in more detail with reference to FIGS. 2 and 3, which each show a version of the means for short-circuiting a voice-coil section. The means 18.1 for short-circuiting a voice-coil section 4.1 are shown in FIG. 2. It is evident that the means 18.2 to 18.*n* in FIG. 1 may be constructed in the same way. The means 18.1 comprise a switch 20 arranged in parallel with the voice-coil section 4.1. This switch 20 is closed if the voice-coil section 4.1 is not driven i.e. if the switch 14.1 is open. This situation is shown in FIG. 2. The switch 20 is open if the voice-coil section 4.1 is driven, i.e. if the switch 14.1 is closed. The means 18.1 also comprise an inverting element 21, whose input is coupled to the line 13.1 for applying the corresponding bit to the inverting element and whose output signal is applied to the switch 20 for controlling this switch. If the bit applied to the switch 14.1 via the line 13.1 is low (logic "zero"), this switch is open. A high value (logic "one") is then applied to the switch 20, via the inverting element 21, so that this switch is closed. Conversely, if the bit is high (logic "one"), switch 14.1 is closed. A low value (logic "zero") is then applied to the switch 20 via the inverting element 21**, so that this switch is open.

Figure 3:
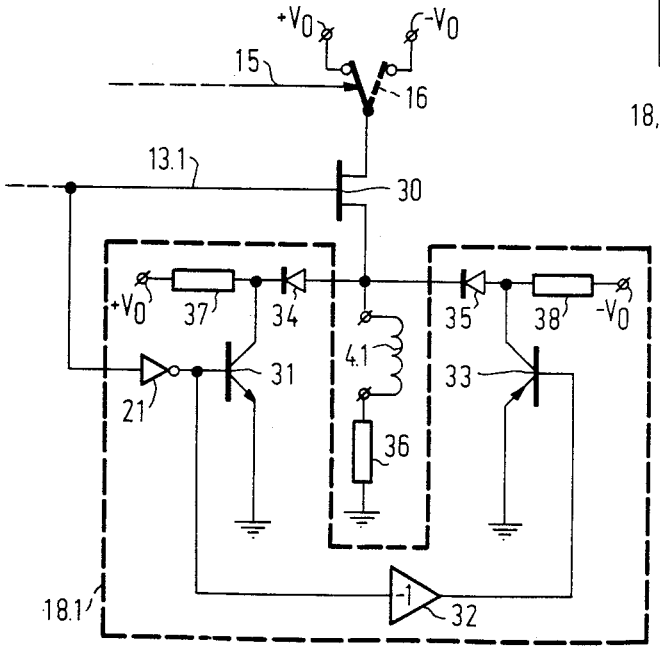

FIG. 3 shows the circuit of FIG. 2 in more detail. In FIG. 3 the switch 14.1 shown in FIG. 2 is constituted by a field-effect transistor 30. The output of the inverting element 21 in the means 18.1 is coupled to the base of an npn transistor 31 and, via an amplifier 32 having a gain factor equal to $-1$, to the base of a pnp transistor 33. The emitters of the two transistors 31 and 33 are connected to earth. The collectors of the two transistors 31 and 33 are connected to the positive voltage supply $V_o$ and the negative voltage supply $-V_o$ respectively via resistors 37 and 38 respectively, and to one end of the voice-coil section 4.1 via diodes 34 and 35, respectively. The other end of the voice coil section 4.1 is connected to earth via a measurement resistor 36, whose presence will be explained hereinafter. The resistors 37 and 38 are biasing resistors.

The circuit operates as follows. If a high signal (logic "one") appears on the line 13.1 the field-effect transistor 30 is conductive. Via the inverting element 21 a logic "zero" signal (a voltage approximately equal to zero volts) is applied to the bases of the transistors 31 and 33 in such a case, so that these transistors are both cut-off. Conversely, in the case of a low signal (logic "zero") on the line 13.1 a high signal (logic "one") will appear on the output of the inverting element 21. Consequently, a high voltage (say $+5$ V) appears on the base of transistor 31 and a "high" negative voltage (in the present case $-5$ V) on the base of transistor 33. Consequently, both transistors are conductive. As the other voice-coil sections are energized, the voice-coil former including the non-energized voice-coil section 4.1 will move to and fro in the air gap of the magnet system. As a result of this movement a current will be induced in the voice-coil section 4.1, which is short-circuited via the transistors 31 and 33. During the movement of the voice-coil section 4.1 in one direction (i.e. during alternate half periods of the movement of the voice-coil former) a current will flow from the voice-coil section 4.1 through the diode 34 and the transistor 31 to earth and back again to the voice-coil section 4.1 through the measurement resistor 36. During the movement of the voice-coil section 4.1 in the other direction the induced current flows through the voice-coil section 4.1 in the other direction via transistor 33 and diode 35.

The measurement resistor 36 is irrelevant to the present invention and may be dispensed with. However, if the step described in the foregoing is applied to the loudspeaker system described in the Applicant's European Application which claims priority from Netherlands Patent Application No. 83.03.185 (PHN 10 764) and which is filed simultaneously with the present Application it may be desired that the measurement resistor 36 will be arranged in series with the voice-coil section 4.1. When the voice-coil section is short-circuited, as described in the present Application, steps must then be taken to short-circuit the series arrangement of the voice-coil section 4.1 and the measurement resistor 36.

It is to be noted that the scope of the invention is not limited to the embodiments described with reference to the Figures. The invention is equally applicable to those embodiments which differ from the embodiments shown in respects which do not relate to the inventive principle. For example, the invention may also be applied to loudspeakers of the ribbon type. The diaphragm of such a loudspeaker may comprise a single foil on which a plurality of voice-coil sections are arranged in the form of a conductive layer, or in which the diaphragm comprises a plurality of superimposed and interconnected foils, one or more voice-coil sections in the form of a conductive layer being arranged on each foil.

What is claimed is:

1. In a loudspeaker system for converting a digitized electric signal having a plurality of bits, each of said bits having a first or a second value, into an acoustic signal, said system having an electrodynamic loudspeaker comprising a voice coil device having a plurality of voice coil sections corresponding in number to said plurality of bits of said digitized electric signal, said system further having means for driving each of said plurality of voice coil sections when a respective one of said bits has said first value, the improvement comprising means for short-circuiting a voice coil section when the respective one of said plurality of bits has said second value.

2. A loudspeaker system as claimed in claim 1, wherein said means for short-circuiting a voice-coil section comprises a switch corresponding to and arranged in parallel with each of said voice-coil sections, and means for controlling said switches in such a manner that a switch is closed if the associated voice-coil section is not driven and is open if the associated voice-coil section is driven.

3. A loudspeaker system as claimed in claim 2, wherein said means for short-circuiting a voice-coil section comprises an inverting element corresponding to each switch and having an output coupled to the corresponding switch, an input of said inverting element being coupled to an input of said means for driving said voice-coil section.

4. A loudspeaker system as claimed in claim 2, wherein each of said switches comprises a transistor having an emitter-collector circuit arranged in parallel with the associated voice-coil section.

5. A loudspeaker system as claimed in claim 4, wherein each of said switches comprises a first transistor of one conductivity type and a second transistor of the other conductivity type, both transistors are arranged in parallel with the voice coil section, wherein the emitters of both transistors are coupled to one end of the associated voice-coil section and the collectors of both transistors are coupled to the other end of the associated voice-coil section, the output of the inverting element is coupled to the base of one transistor and, via an amplifier stage with a negative gain factor, to the base of the other transistor.

6. A loudspeaker system as claimed in claim 5, wherein said negative gain factor is equal to $-1$.

* * * * *